US011903456B2

(12) United States Patent
Muenmai

(10) Patent No.: US 11,903,456 B2
(45) Date of Patent: Feb. 20, 2024

(54) FLAT BRACELET CLIP

(71) Applicant: PANDORA A/S, Kobenhavn V (DK)

(72) Inventor: Netima Muenmai, Samutprakarn (TH)

(73) Assignee: Pandora, Kobenhavn V (DK)

( * ) Notice: Subject to any disclaimer, the term of this patent is extended or adjusted under 35 U.S.C. 154(b) by 0 days.

(21) Appl. No.: 17/930,119

(22) Filed: Sep. 7, 2022

(65) Prior Publication Data

US 2022/0408884 A1 Dec. 29, 2022

Related U.S. Application Data

(63) Continuation of application No. 17/051,230, filed as application No. PCT/DK2019/050144 on May 8, 2019, now Pat. No. 11,490,694.

(30) Foreign Application Priority Data

May 11, 2018 (DK) ..... PA 2018 70287

(51) Int. Cl.

| | |
|---|---|
| ***A44C 5/00*** | (2006.01) |
| ***A44B 13/02*** | (2006.01) |
| ***A44C 1/00*** | (2006.01) |
| ***A44C 5/18*** | (2006.01) |

(52) U.S. Cl.

CPC ..... *A44B 13/02* (2013.01); *A44C 1/00* (2013.01); *A44C 5/18* (2013.01); *A44D 2201/00* (2013.01)

(58) Field of Classification Search

CPC .. A44C 13/02; A44C 1/00; A44C 5/18; A44C 13/00; A44C 15/00; A44C 17/0208; A44C 25/00; A44C 25/007; A44C 15/005; A44D 2201/00; F16B 2/10

See application file for complete search history.

(56) References Cited

U.S. PATENT DOCUMENTS

| | | | |
|---|---|---|---|
| 4,754,534 | A | 7/1988 | Helwick |
| 5,085,060 | A | 2/1992 | Matsushita |
| 5,575,042 | A | 11/1996 | Kalbach |
| 5,671,508 | A | 9/1997 | Murai |
| 5,687,585 | A | 11/1997 | Ferrell |
| 6,817,468 | B2 | 11/2004 | Horesh |
| 8,840,244 | B2 | 9/2014 | Terry |
| 9,302,074 | B2 | 4/2016 | Atkinson et al. |
| 2007/0251268 | A1 | 11/2007 | Gisser et al. |
| 2009/0162816 | A1 | 6/2009 | Charles |
| 2011/0048072 | A1 | 3/2011 | Mullen et al. |

(Continued)

FOREIGN PATENT DOCUMENTS

| | | | | |
|---|---|---|---|---|
| CH | 262362 | A | 6/1949 | |
| DE | 10319989 | A1 * | 11/2004 | ..... A45F 5/02 |

(Continued)

OTHER PUBLICATIONS

International Search Report and Written Opinion, dated Jul. 12, 2019, 10 pages, issued in Application No. PCT/DK2019/050144.

(Continued)

*Primary Examiner* — Jack W Lavinder
(74) *Attorney, Agent, or Firm* — AVEK IP, LLC

(57) ABSTRACT

A clip (100) for being strung on a bracelet and/or a necklace, said bracelet or necklace comprising an elongate member with a flat cross-sectional shape and with a first substantially flat major surface and a second substantially flat major surface.

13 Claims, 4 Drawing Sheets

(56) References Cited

U.S. PATENT DOCUMENTS

| | | | |
|---|---|---|---|
| 2012/0210748 | A1 | 8/2012 | Katib |
| 2016/0166020 | A1 | 6/2016 | Lovett |
| 2017/0280838 | A1 | 10/2017 | Gray |
| 2019/0324295 | A1 | 10/2019 | Marzano |

FOREIGN PATENT DOCUMENTS

| | | | | |
|---|---|---|---|---|
| EP | 0638255 | A1 | 2/1995 | |
| WO | 2002032249 | A2 | 4/2002 | |
| WO | 2005009166 | A2 | 2/2005 | |
| WO | 2006125155 | A1 | 11/2006 | |
| WO | WO-2010037183 | A1 * | 4/2010 | ..... A01K 93/00 |
| WO | 2014100446 | A1 | 6/2014 | |
| WO | 2014121797 | A1 | 8/2014 | |
| WO | 2017013066 | A1 | 1/2017 | |
| WO | 2017013067 | A1 | 1/2017 | |
| WO | 2018184647 | A1 | 10/2018 | |
| WO | 2019214792 | A1 | 11/2019 | |

OTHER PUBLICATIONS

Search Report, dated Jul. 17, 2018, 4 pages, issued in DK Application No. PA 2018 70287.
Office Action, dated Mar. 9, 2023, received in corresponding EU Application No. 19724341.3.

* cited by examiner

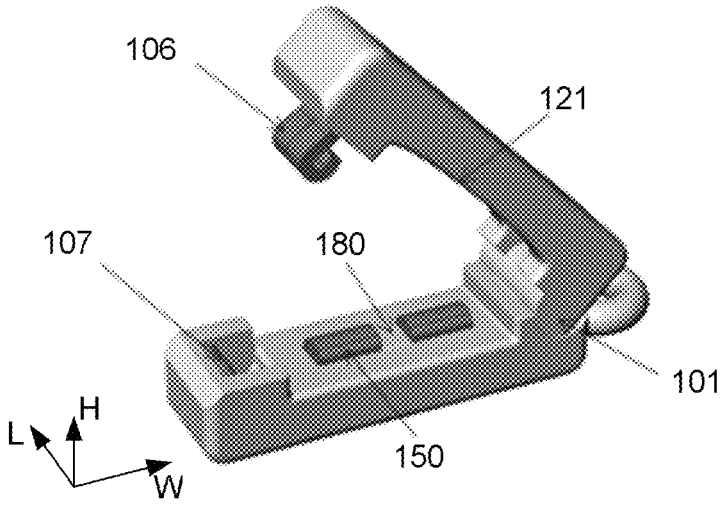
Fig. 3
Fig. 4
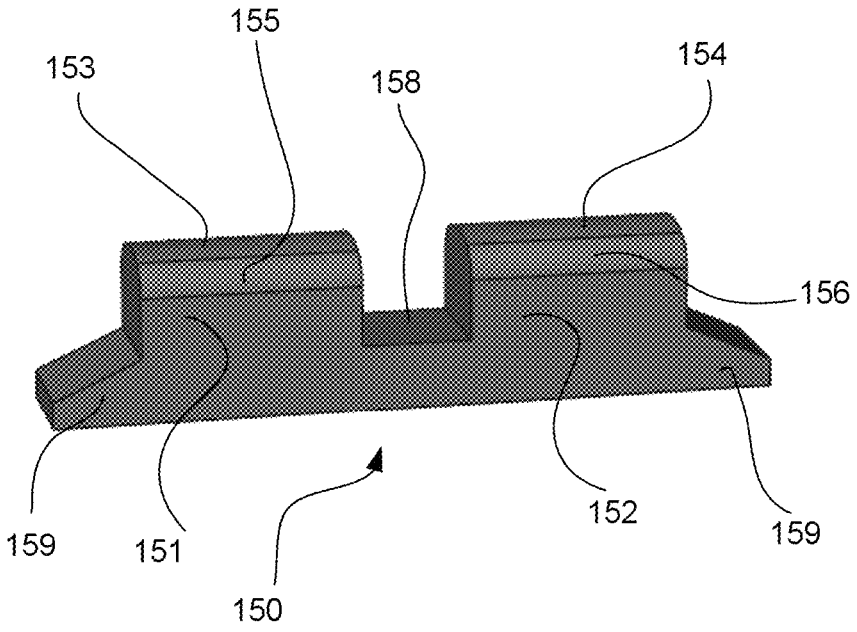

130
180
150
180'
150'
130
150
101
200
150'
180
180'
131
W
L
101

180'
130
130
150
150'
180
180
200
150'
101

101
130
130
180
150'
150
180'
131
180
W
150
L 101
200
101

FLAT BRACELET CLIP

CROSS-REFERENCE TO RELATED APPLICATIONS

This application is a continuation of and claims priority to U.S. application Ser. No. 17/051,230, filed Oct. 28, 2020, which is the U.S. national phase of, and claims priority to, International Application No. PCT/DK2019/050144, filed May 8, 2019, which designated the U.S., and which claims priority to Danish Patent Application No. PA 2018 70287, filed May 11, 2018.

FIELD OF THE DISCLOSURE

The present disclosure relates to clips for flat bracelets and/or flat necklaces, and to flat bracelets or flat necklaces comprising such a clip.

BACKGROUND

Jewelry, such as necklaces and bracelets, often consists of a plurality of freely movable ornamental components, e.g. beads or charms strung on an elongated member, e.g. a chain, wire, or string. To prevent the freely movable beads from grouping together at the bottom of the elongated member or to group the freely movable beads in certain areas of the elongated member, an ornamental component provided with a stopping mechanism configured to grip the necklace or bracelet may be used. The ornamental component can be fixed or attached to the elongated member in one or more positions along the elongated member and has such dimensions that the freely movable beads are not able to move past the component. A variety of such ornamental components have been suggested in the prior art.

Resilient materials such as silicone are commonly used for stopping mechanisms. The resilient material will deform when it comes into contact with a bracelet/necklace resulting in a spring force (attempting to restore the original shape of the stopping mechanism) that will releasably secure the ornamental component to a selected position of the bracelet/necklace.

The applicant's WO 2017/013066 discloses a clip with such a resilient insert element which allows the clip to fit onto securely onto selected positions of a circular elongated member of a bracelet and/or necklace. To retain the resilient insert element, the clip is provided with a cavity in the through hole, wherein an anchor portion of the resilient insert element has dimensions larger than the opening of the cavity so that it is retained when subjected to forces in an axial direction, i.e. the longitudinal direction of the elongate member.

However, the ornamental components of the prior art are adapted to be strung on bracelets and/or necklaces, wherein the elongate member has a circular cross section it thus remains a problem how to provide an ornamental component that is capable of wreathing a flat bracelet.

Furthermore, securely retaining the resilient insert element in the cavity may be an issue as the anchor portion of the resilient insert element, due to the flexibility of the resilient insert element, may lose contact with the bottom of the cavity. This problem has proven to become more significant when altering the dimensions of the resilient insert element to adapt it to engage flat bracelets, as the increased width to height ratio makes the resilient insert element even more prone to bending.

Thus, there is still a need for clips capable of fitting onto flat bracelets and/or necklaces.

SUMMARY

In a first aspect of this disclosure, the objects laid out in the background may be solved by a clip for being strung on a bracelet and/or a necklace, said bracelet or necklace comprising an elongate member with a flat cross-sectional shape and with a first substantially flat major surface and a second substantially flat major surface. The clip comprises a first part and a second part connected by a hinge, said first and second parts being moveable between an open and a closed state by rotation about a hinge axis of said hinge, wherein the clip is adapted for gripping the elongate member in the closed state and for being released from the elongate member in the open state. The clip has, in the closed state, a through hole extending in a longitudinal direction between a first and a second opening, said through hole having a substantially rectangular cross sectional shape in said longitudinal direction, a width of said cross sectional shape being at least twice a height of said cross sectional shape. The first part has a rigid, substantially flat surface, which defines a first surface of the through hole adapted to engage the first major surface of the elongate member in said closed state, and the second part has a substantially flat surface, which defines a second surface of the through hole opposite of the first surface, said substantially flat surfaces partly defining said through hole. The clip further comprises a first resilient insert element retained in said second part. Said first insert element has a first projection and a second projection, each of said projections protruding into the through hole beyond said second surface, each of said projections comprising a gripping surface adapted to engage the second major surface of the elongate member in said closed state of the clip, said gripping surfaces partly defining said through hole. Said first insert element is retained in said second part by a retaining element attached to said second part and extending in said longitudinal direction, said retaining element separating said first and second projections from each other.

By providing such a clip, wherein the first resilient insert element is retained by a retaining element, the area of the first resilient part between the first and second projections is prevented from bending upwards into the through hole when subjected to frictional forces between the first resilient insert element and the elongate member in the longitudinal direction. This ensures that the resilient insert element remains in the cavity.

Thus, the clip is configured so that the two major surfaces of the elongate member can be gripped between the resilient insert element and the first surface to allow said clip to be releasably secured at selected positions along the elongated member. Thus, a clip which can be arranged at a selected position on a flat necklace and/or bracelet is provided.

The clip may be moved by opening it and repositioning it at another selected position or by user applying a force, i.e. an intentional force exerted in the longitudinal direction on the clip, whereby the clip in the closed state can be moved along the elongated member.

Additionally, by using a combination of a rigid and a resilient surface for securing the clip to the elongated member a clip is provided that is easier to manufacture and more durable in daily use i.e. even if the resilient insert element gets slightly worn the rigid first surface will still maintain its shape and secure a good fit with the elongated member of the bracelet/necklace.

Furthermore, the rigid first surface may prevent a user from moving the clip over a part of the elongated member having an extended diameter, such as a band on the elongated member, thereby protecting the resilient insert element from the resulting significant forces in the directions perpendicular to the longitudinal direction that may be potentially very damaging. In the content of this description, the term "a band" is to be interpreted as an element that surrounds the circumference of a part of the elongated element. Thereby a cross section of the elongated element at the location of the band will have a width and/or height which is greater than a width and/or height of the elongated element itself, at a part where no band is present.

A "clip", as this term used in the present disclosure, may alternatively be denoted "a jewelry clip" and may be any component that can be clipped on a bracelet and/or necklace for ornamental purposes. A clip according to the first aspect of this disclosure may be used to organize freely movable beads on a bracelet or necklace, e.g. two clips may be arranged at desired position on an elongated member of a bracelet or necklace, whereby they resiliently grip the elongated member. Consequently, the bracelet or necklace is divided into three distinct zones for freely movable beads. This may be used to prevent all the freely movable beads from grouping together.

It should be noted, that in the context of this disclosure the term "bracelet" is not exclusive to jewelry articles for being worn on the wrists, but is also intended to cover ankle bracelets, sometimes referred to as anklets or ankle bracelets.

In the context of the present disclosure the term "wreathe" is to be understood as meaning to cover, surround, or encircle.

In the context of the present disclosure the term "rigid" is to be understood as being substantially unable to bend or be forced out of shape during normal use.

In the context of the present disclosure the term "resilient" is to be understood as being able to recoil or spring back into shape after bending, stretching, or being compressed.

The through hole is further partly defined by two side walls provided by the first and/or second parts.

The first resilient insert element is an element that is deformable under the influence of a particular force and capable of recoiling back into substantially its original shape once the particular force is removed.

The resilient insert element may be made of a resilient material such as a silicone material including a silicone rubber. Preferably the resilient insert element is manufactured from a material comprising at least 50, more preferred at least 80, more preferred at least 95 percent of, most preferred essentially consists of, a material or a combination of materials selected from the group consisting of silicone, silicone rubber, natural rubber, synthetic rubber, PTFE, polyethylene, polypropylene, HDPE, polystyrene and nylon. The resilient insert element material may comprise additives and fillers, including coloring agents.

The resilient insert element is spaced apart from the first part in a relaxed/uncompressed state and in a compressed state, when the clip is arranged on the elongated member. In the context of the present disclosure the term "spaced apart" is to be understood as being separated, having spaces between, not being in direct contact.

The resilient insert element may be secured to the second part by any means such as by an adhesive or by griping means in the second part.

The first and second parts of the clip may provide the primary structural strength of the clip. The clip may be made of metal, glass, wood, plastic, ceramics, or a combination thereof. The first and second parts of the clip may be individually integrally molded, i.e. made from a single mound. The clip may have any outer shape such as round or rectangular.

In the context of this disclosure, the term "substantially flat surface" will refer to a plane surface or a surface with a slight curvature, "slight" meaning that the width of the plane surface is at least 10 times the difference in height, i.e. the difference between the two extreme points of the first surface in the height direction, of the first surface.

In an embodiment said first insert element has a cross sectional shape in said longitudinal direction, said cross sectional shape having a width and a height, said height extending normal to said width, a greatest said width of said cross sectional shape being at least twice a greatest said height of said cross sectional shape.

In some embodiments the second part comprises a cavity having an opening in the second surface, wherein the first resilient insert element comprises an anchor portion inside said cavity, said first and second projections protruding from said anchor portion through said opening in the second surface, wherein the dimensions of said anchor portion are greater than the dimensions of said opening in the second surface so that the cavity is configured to secure the first resilient insert element in said second part.

Consequently, the first resilient insert element may be secured to the second part in an easy and secure manner. This further allows the first resilient insert element to be secured to the second part without the use of an adhesive, thereby protecting the user from coming into contact with potential harmful chemicals and increasing the aesthetic value of the ornamental component. In some embodiments the cavity is shaped so as to grip the first resilient insert element and secure it in said second part.

During manufacture of the clip the anchor portion of the first resilient insert element may thus be readily arranged in said cavity using the resilience of the material to compress it to fit through the opening of the cavity. When inserted into the cavity, the first resilient insert element may again expand to fit into the cavity and be secured therein. Following the insertion of the first resilient insert element into the cavity, the retaining element is then arranged between the first and second projections to ensure that the first resilient insert element will not come out of the cavity during use.

In some embodiments the first surface on the first part has a shape that is substantially equal one of the major surfaces of the elongated member of the bracelet/necklace. Hereby the second gripping surface may fit snugly around the elongated member with a substantially flat major surface, providing a larger area of contact.

In some embodiments, the first surface is convex in the longitudinal direction and/or is provided with rounded edges towards the first and second openings. The advantage of this is that wear, caused by the user forcefully moving the clip along the elongate member, is reduced or at least limited to a central region, i.e. in the longitudinal direction, of the first surface, thereby maintaining the structural integrity and visual appearance of the first surface near the first and second openings, where the surface may be visible to the user when the clip is clipped onto the elongate member.

In some embodiments, the first surface is arched in a width direction perpendicular to the longitudinal direction. The advantage of this is that wear on the first surface, caused by the user forcefully moving the clip along the elongate member, is limited to the peripheral edges, i.e. in the width direction, thereby maintaining the structural integrity of the first surface near the longitudinal center axis, thus prolonging the lifespan of the clip.

In some embodiments, the gripping surfaces are convex in the longitudinal direction and/or are rounded at the edges in the longitudinal direction. The advantage of providing the gripping surfaces with rounded edges, i.e. not sharp edges, is that the wear on the edge, caused by the user forcefully moving the clip along the elongate member, is reduced, thus prolonging the lifespan of the resilient insert element.

In embodiments, the length of the first resilient insert element, i.e. in the longitudinal direction, is one half or less, preferably one third or less, of the length of the through hole. This will achieve a greater structural integrity of the second part, as the size of the cavity can be reduced, whereby less material will have to be removed/left out. Furthermore, this may reduce the manufacturing costs of the clip and will allow the resilient insert element to be spaced apart from the peripheral edges, i.e. the edges at the first and second openings, thereby increasing the aesthetic experience for the user.

In some embodiments, the clip further comprises a second resilient insert element retained in said second part. This may be particularly advantageous in embodiments, wherein the length of the through hole is comparable or greater than the width of the through hole as the contact surface between the gripping surfaces of the first and second resilient insert elements and the second major surface of the elongate member required to keep the clip at a selected position may be provided by two shorter, i.e. in the longitudinal direction, resilient insert elements rather than one long first resilient insert element. The clip may thus benefit from the advantages of having a greater height to length ratio described above.

It should be noted, that the second resilient insert element in most embodiments is identical to the first resilient insert element as described in other embodiments. Additionally, the clip may also comprise a second cavity in the second surface, said cavity being adapted to retain the second resilient insert element.

In embodiments, said second insert element has a cross sectional shape in said longitudinal direction, said cross sectional shape has a width and a height, said height extends normal to said width, a greatest said width of said cross sectional shape being at least twice a greatest said height of said cross sectional shape. Said second insert element has a first projection and a second projection, each said projections protruding into the through hole beyond said second surface, each said projection comprising a gripping surface adapted to engage the second major surface of the elongate member in said closed state of the clip, said gripping surfaces partly defining said through hole Said second insert element is retained in said second part by a second retaining element attached to said second part and extending in said longitudinal direction, said second retaining element separating said first and second projections from each other.

The second resilient insert element may thus benefit from the advantages described for the first resilient insert element.

In some embodiments, the first resilient insert element is arranged proximate to the first opening and the second resilient insert element is arranged proximate to the second opening. In such embodiments, the first and second resilient insert elements are preferably arranged symmetrically about a midpoint of the through hole, i.e. in the longitudinal direction. This will ensure the friction provided between the gripping surfaces of the first and second resilient insert elements and the second major surface is distributed symmetrically over said midpoint.

In some embodiments, the first retaining element extends over a full length of the first resilient insert element part, and, if present, the second retaining element extends over a full length of the second resilient insert element. The advantage of providing a retaining element which spans the full length of a respective resilient insert element is that the resilient insert element will be unable to slip out under the retaining element in the longitudinal direction.

In a second aspect of this disclosure, the objects laid out in the background section may be solved by a bracelet or a necklace set comprising:

an elongate member with a flat cross-sectional shape, and with a first substantially flat major surface and a second substantially flat major surface; and a clip comprising a first part and a second part connected by a hinge, said first and second parts being moveable between an open and a closed state by rotation about a hinge axis of said hinge, wherein the clip is adapted for gripping the elongate member in the closed state and for being released from the elongate member in the open state.

The clip has, in the closed state, a through hole extending in a longitudinal direction between a first and a second opening, said through hole having a substantially rectangular cross sectional shape in said longitudinal direction, a width of said cross sectional shape being at least twice a height of said cross sectional shape. The first part has a rigid, substantially flat surface, which defines a first surface of the through hole adapted to engage the first major surface of the elongate member in said closed state, and the second part has a substantially flat surface, which defines a second surface of the through hole opposite of the first surface, said substantially flat surfaces partly defining said through hole.

The clip further comprises a first resilient insert element retained in said second part. Said first insert element has a cross sectional shape in said longitudinal direction, said cross sectional shape having a width and a height, said height extending normal to said width, a greatest said width of said cross sectional shape being at least twice a greatest said height of said cross sectional shape. Said first insert element has a gripping surface adapted to engage the second major surface of the elongate member in said closed state of the clip, said gripping surfaces partly defining said through hole.

By providing such a bracelet or a necklace set, a flat bracelet/necklace which can be customized by the users themselves is provided.

The elongated member may be any elongated member suitable for jewelry such as a metal chain, leather string, a fabric string, or any other type of chain.

In some embodiments, the bracelet or necklace further comprises a band fixed to the elongated member; the band having an extended width compared with the width of remaining parts of the elongated member, wherein the clip is configured so that the first surface and the gripping surface grips the band to allow said clip to be releasably attached to said band.

The advantage of providing the elongate member with bands, is that the clip may by completely fixed on the band, i.e. not movable along the elongate member, even when subjected to an intentional force in the longitudinal direction by the user.

In some embodiments, the bracelet or necklace further comprises at least one freely moveable ornamental component strung on said elongated member.

In some embodiments, the bracelet or necklace further comprises a plurality of freely moveable ornamental components strung on said elongated member.

In embodiments, the clip is according to the first aspect of this disclosure. The clip may thus benefit from the advantages described above.

In some embodiments the bracelet or necklace further comprises a second clip as disclosed in relation to the first aspect of this disclosure arranged on said elongated member, wherein the second clip is configured so that the rigid, second gripping surface and the resilient element resiliently grips the elongated member to allow said second clip to be releasably secured at selected positions along the elongated member until a particular force is acting on said second clip, whereby the second clip in the closed state can be moved along the elongated member.

BRIEF DESCRIPTION OF THE DRAWINGS

The above and/or additional objects, features and advantages will be further elucidated by the following illustrative and non-limiting detailed description of embodiments, with reference to the appended drawings, wherein:

FIG. 3 shows a perspective view of a clip in the open state;

FIG. 4 shows a perspective side view of a resilient insert element;

DETAILED DESCRIPTION

In the following, embodiments will be described in further detail. Each specific variation of the features can be applied to other embodiments unless specifically stated otherwise. Note that for illustrative purposes the dimensions, especially thicknesses, of the different elements shown may be exaggerated.

Figure 1:
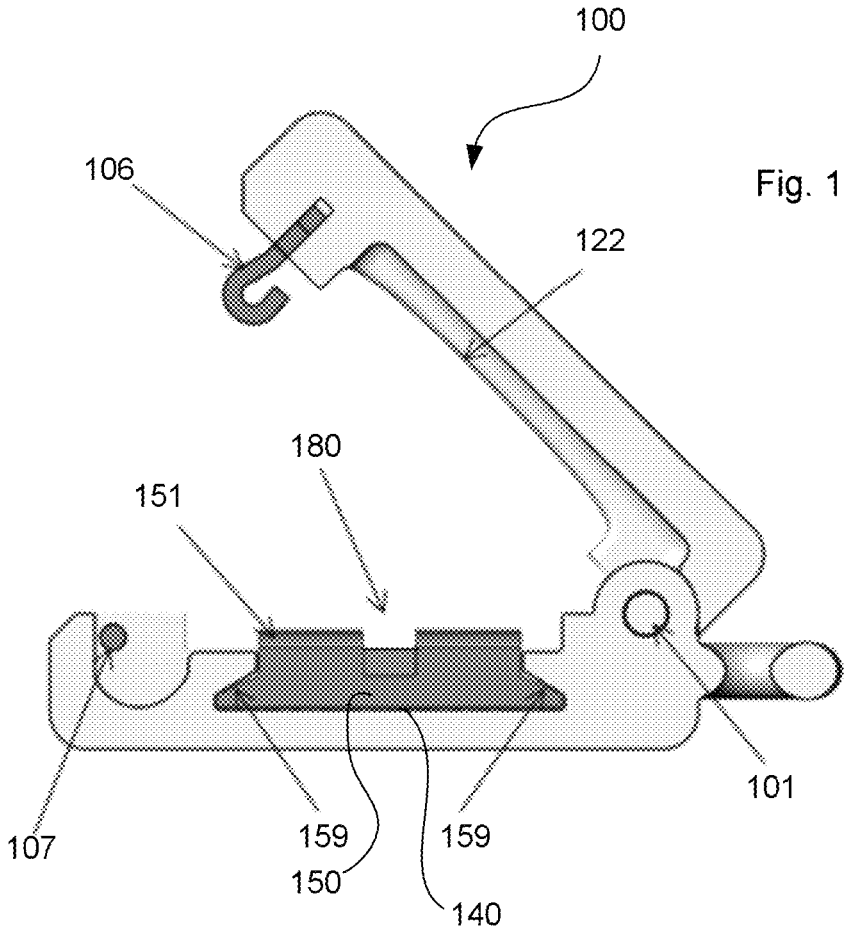
FIG. 1 shows a schematic side view of a clip in the open state.
Figure 2:
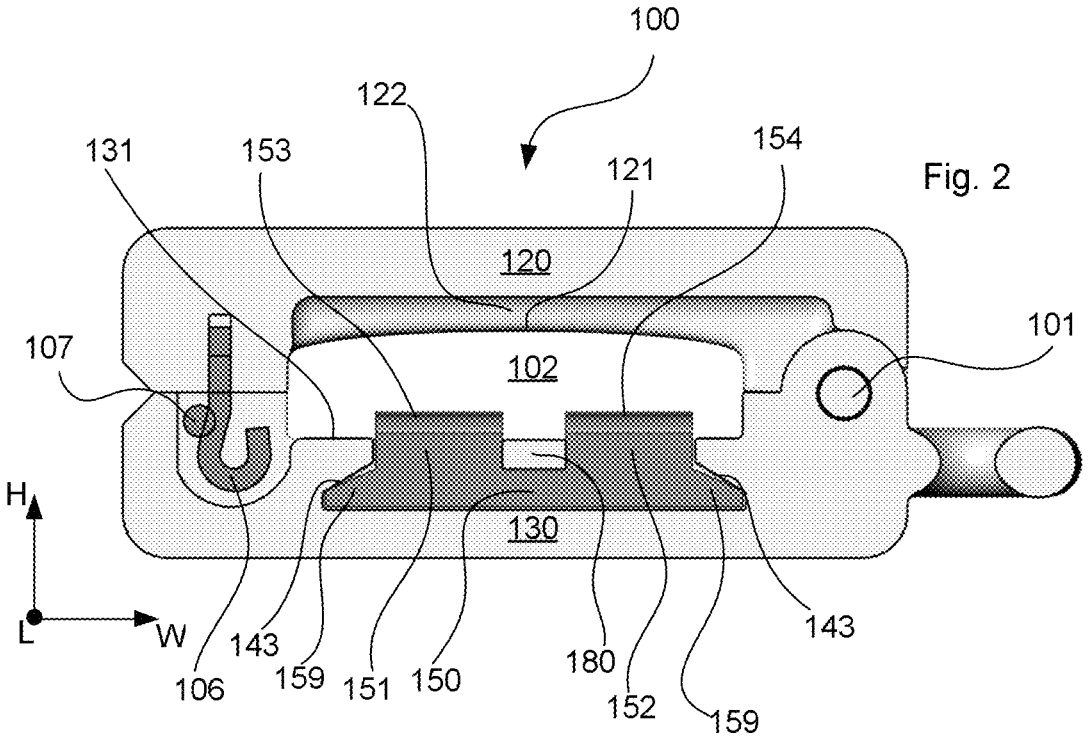
FIG. 2 shows a schematic side view of a clip in the closed state.

Turning first to FIGS. 1 and 2, which show a side view of a first embodiment of a clip in an open and closed state respectively. The clip 100 is a clip for a flat elongated member (such as a leather or metal strap) of a bracelet and/or necklace. The clip 100 comprises a first part 120, i.e. a first half shell, and a second part 130, i.e. a second half shell, which are connected by a hinge 101 allowing the clip to be moved between the open state, shown in FIG. 1, and the closed state, shown in FIG. 2.

To enable the clip 100 to be locked in the closed state, the clip comprises a locking arrangement 106, 107. In the shown embodiment, the locking arrangement 106, 107 comprises a spring 106 and a spring contact point 107, said spring 106 engaging the spring contact point 106 when the clip is closed, whereby the mutual engagement between the two 106, 107 prevents the clip from coming open unintentionally.

In the closed state, shown in FIG. 2, the clip 100 has a through hole 102 allowing the clip 100 to wreathe the elongate member. The through hole 102 extends in a longitudinal direction (L) between a first and a second opening. In this embodiment the through hole 102 and the clip 100 have a substantially rectangular cross-sectional shape in the longitudinal direction. The through hole 102 is partly defined by a first substantially flat surface 121 of the first part 120 and a second substantially flat surface 131 of the second part 130. The through hole 102 is further partly defined by two side walls formed on the first and second parts 120, 130. In the open state, the through hole 102 is open at the side opposite the hinge 101, whereby the clip 100 can be placed onto or removed from the elongate member. Said first surface 121 is adapted for gripping a first of the two major surfaces of the elongate member.

The clip 100 further comprises a resilient insert element 150 arranged in the second part 130. The resilient insert element 150 is adapted for providing friction between the clip 100 and the second major surface of the elongate member to allow the clip 100 to be releasably secured at selected positions along the elongated member, i.e. the resilient insert element 150 and the rigid gripping surfaces 121 grips opposite major surfaces of the elongated member, thereby securing the clip 100 at the selected position of the elongated member.

In the shown embodiment, the first surface 121 is provided with a small curvature in the width direction (W). This curvature limits wear caused by friction between the elongate member and the first surface 121 to the outer regions, i.e. outer edges in the width direction. Furthermore, the edges 122 of the first surface 121 towards the first and/or second openings are rounded so as to limit wear at the edges 122, where the first surface might be visible to the user.

The clip 100 may be forced to move along the elongated member, on which it is positioned by exerting a force in the longitudinal direction (L), preferably using a hand. Thereby the clip 100 can, in the closed state, be moved along the elongated member. To allow the resilient insert element 150 to engage a flat major surface of the elongated member, the resilient insert element 150 has an oblong cross-sectional shape in the longitudinal direction (L) with the width, i.e. in a width direction (W) perpendicular to the longitudinal direction (L), of the resilient insert element 150 being at least twice that of the height, i.e. in a height direction (H) perpendicular to the longitudinal direction (L) and the width direction (W), of the resilient insert element 150.

To secure the resilient insert element 150 in the second part 130, the second part 130 comprises a cavity 140 extending into the second surface 131 and having an opening in the second surface 131. The cavity 140 is formed with side walls 143 with overhang, such that the opening has a smaller area than the base of the cavity 140. The cavity 140 is thus able to retain the resilient insert 150 as the overhanging sidewalls 143 make it difficult for the resilient insert element 143 to fall out of the cavity.

However, due to the oblong cross-sectional shape and the resilience of the resilient insert element 150, the resilient insert element 150 may be bent and/or compressed so that it can be inserted, as is done during assembly, or removed from the cavity 140. To prevent the resilient insert element 150 from unintentionally being removed from the cavity 140, the clip 100 comprises a retaining element 180 extending in the longitudinal direction (L) over the opening of the cavity 140 and over the resilient insert element 150, so that the resilient insert element 150 is securely retained in the cavity 140. In the shown embodiment, the retaining element 180 is formed by a tab extending over the resilient insert element 150.

The resilient insert element 150 comprises a first and a second projection 151, 152 which protrude beyond the second surface 131 so that they can engage the elongate member. Each of the first and second projections 151, 152 comprises a gripping surface 153, 154 which are adapted to engage a major surface of the elongate member to provide friction between the resilient insert element 150 and the elongate member. The retaining element 180 extends between the first and second projections 151, 152 so that the resilient insert element 150 is securely retained in the cavity 140. The edges of the gripping surfaces 153, 154 in the longitudinal direction are preferably rounded as shown in FIG. 4. The gripping surfaces 153, 154 will thereby comprise rounded portions 155, 156 which reduce wear on the resilient insert element 150 when the elongate member is forced to move by the user.

FIG. 3 shows a perspective view of the clip 100 described above. As can be seen, the retaining element 180 extends over the entire length of the resilient insert element 150, thus making it impossible for the resilient insert element 150 to come out of the cavity 140 unintentionally. To achieve this configuration, the retaining element 180 is either attached to the second part 130 after insertion of the resilient insert element 150 into the cavity or attached before and bended upwards so that the resilient insert element 150 can be inserted into the cavity after which the retaining element 180 can be bend down in the correct position and optionally welded/soldered to ensure a solid attachment.

FIG. 4 shows the resilient insert element 150 by itself from a perspective view. The resilient insert element 150 comprises two anchor portions 159 which extend outwards in the width direction (W), said anchor portions 159 being adapted to fit in under the overhanging side walls 143 of the cavity 140. Furthermore, the resilient insert element 150 has a groove 158 between the first and second projections 151, 152, said groove 158 being formed to accommodate the retaining element 180, thereby limiting the freedom of movement for the resilient insert element 150 once inserted into the cavity 140 and retained by the retaining element 180.

Figure 5:
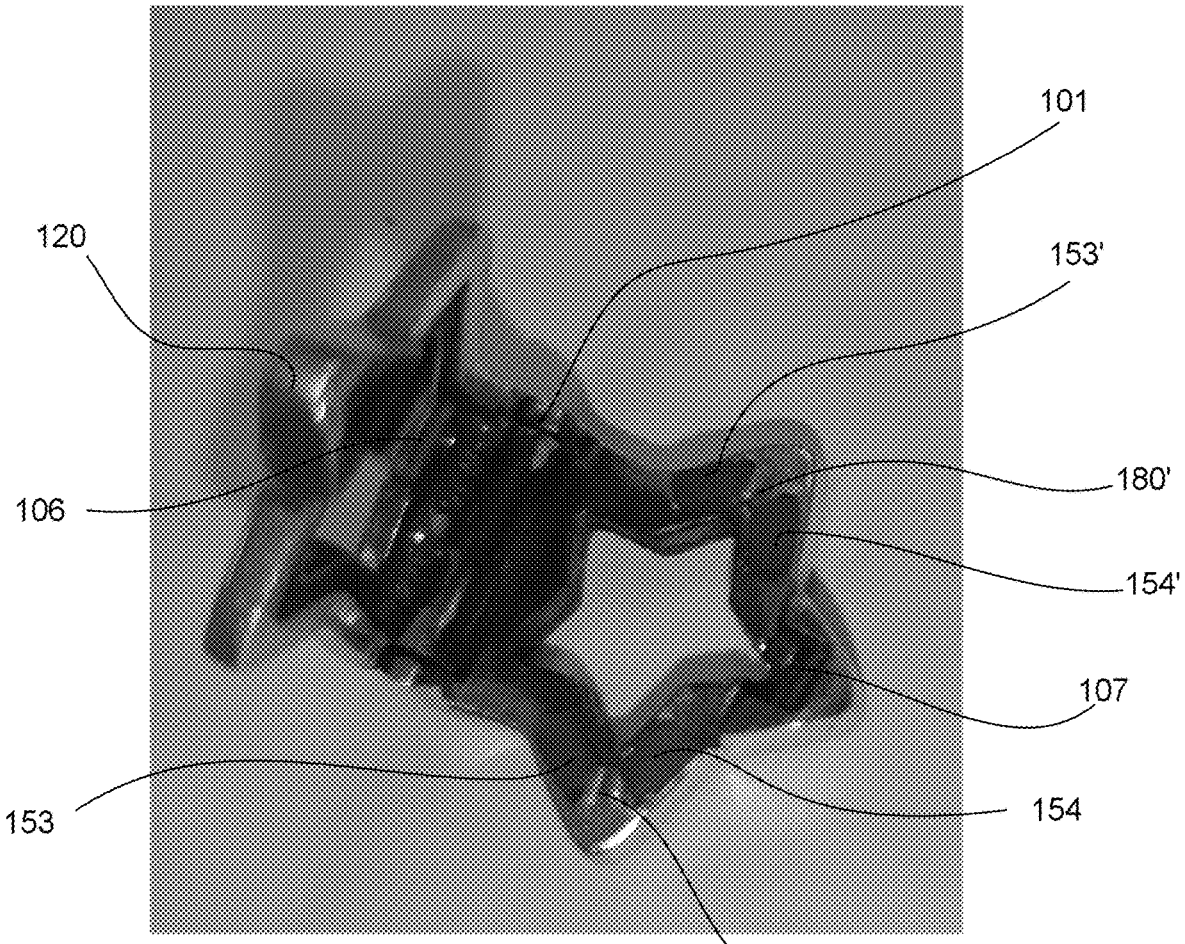
FIG. 5 shows a top view of a clip in the open state.
Figure 6:
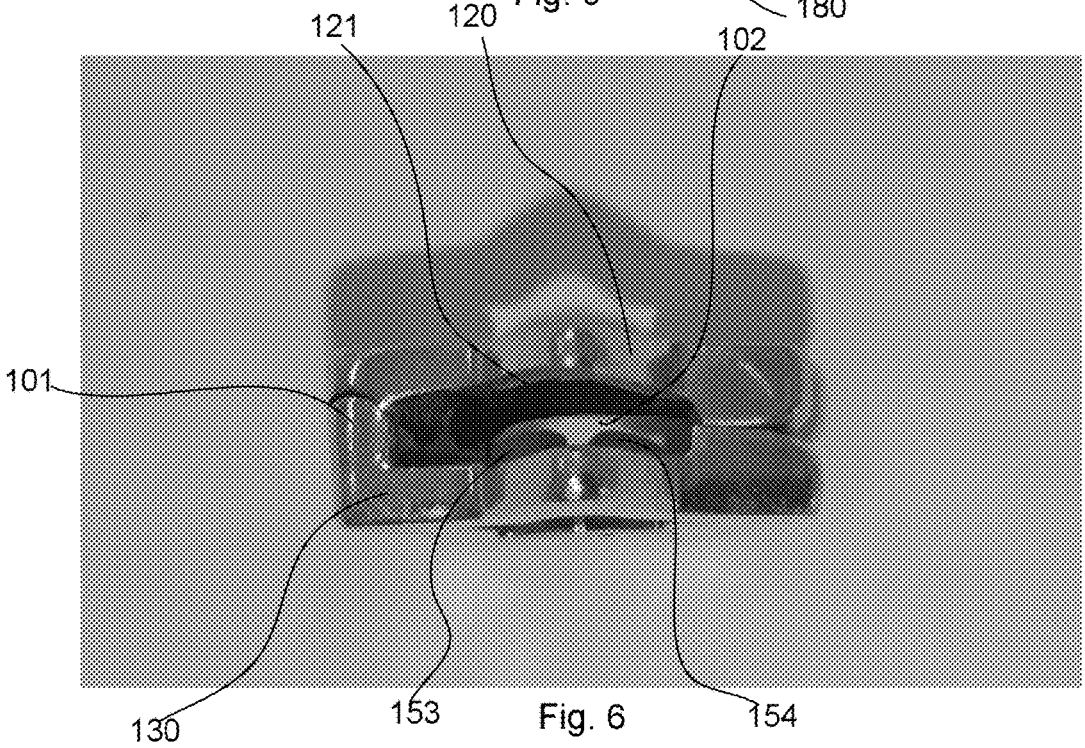
FIG. 6 shows a side view of a clip in the closed state.

Turning now to FIGS. 5 and 6, another embodiment of a clip 100 is shown in the open and in the closed state, respectively. The shown embodiment is largely identical to the embodiment shown in FIGS. 1 to 3 but differs in the following.

The shown clip 100 has an outer shape like that of a star to provide an aesthetic appearance. This shape means that the length of the through hole 102, i.e. in the longitudinal direction (L), is comparable to the width of the through hole 102, i.e. in the width direction (W). To provide sufficient friction for such a clip 100 to remain at the selected location on the elongate element, the clip 100 could be provided with a longer resilient insert element 150.

Instead, the shown embodiment comprises a second resilient insert element 150' arranged in another cavity 140' in the second surface 131. The second retaining element 150' is substantially identical to the first retaining element 150 described in the previous embodiment. The first and second retaining elements 150, 150' are arranged proximate to respective ones of the first and second openings, so that the friction between the gripping surfaces of the retaining elements 150, 150' and the elongate member is even throughout the length of the through hole, and so that the elongate member is gripped more securely near the first and second openings.

Figures 7A, 7B, 7C:
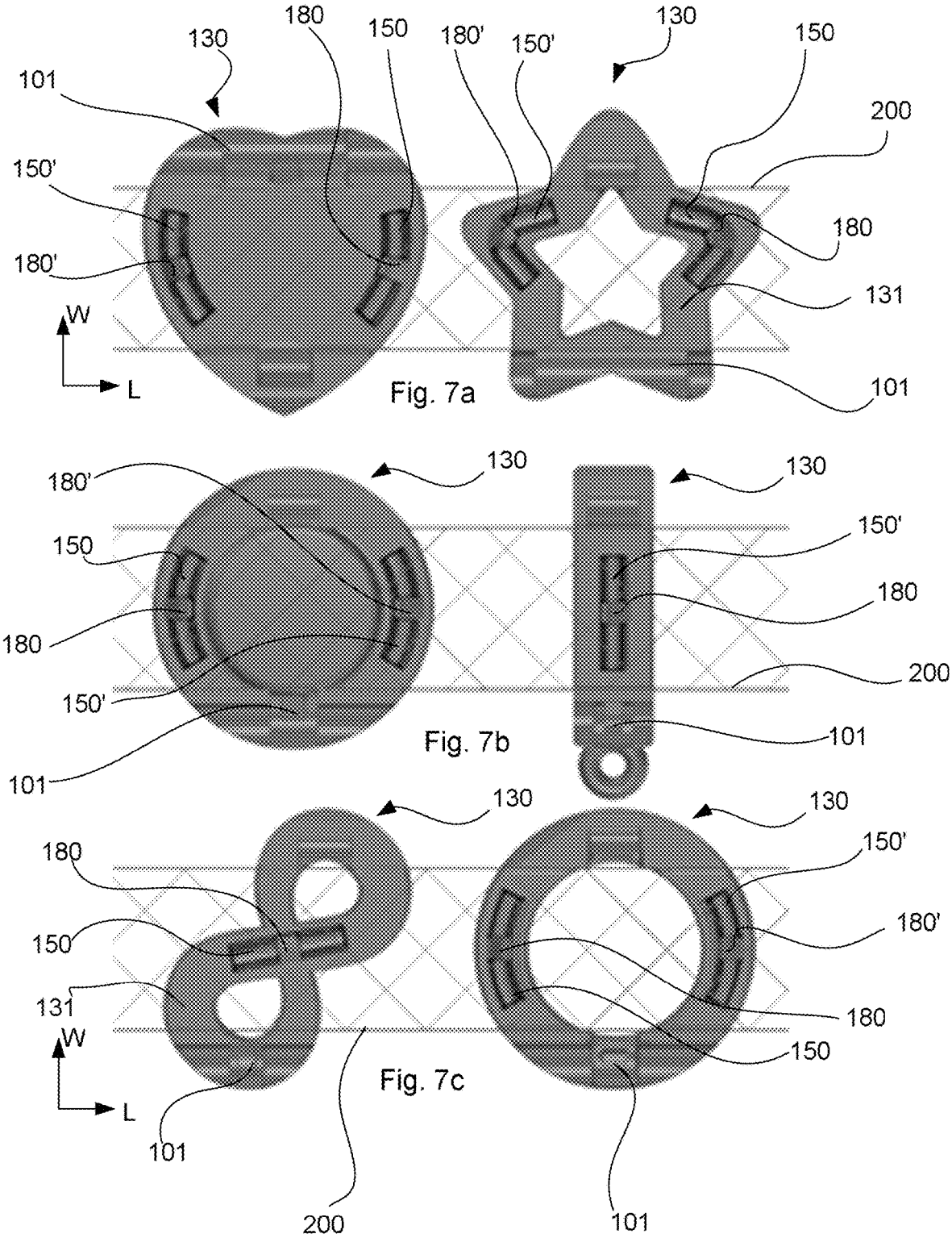
FIG. 7*a-c* show a top view of the second part of various embodiments of clips.

Turning now to FIGS. 7*a-c*, the second part 130 of various embodiments of the clip 100 is shown from a top view. The first parts 120 of the shown embodiments are not shown for illustrative purposes. In FIGS. 7*a-c*, the elongate member 200 is shown.

The invention claimed is:

1. A bracelet set or a necklace set comprising:

an elongate member with a flat cross-sectional shape, and with a first substantially flat major surface and a second substantially flat major surface; and a clip comprising a first part and a second part connected by a hinge, said first and second parts being moveable between an open and a closed state by rotation about a hinge axis of said hinge, wherein the clip is adapted for gripping the elongate member in the closed state and for being released from the elongate member in the open state, the clip having a top surface and a bottom surface, the hinge being generally centered between the top surface and the bottom surface;

the clip having, in the closed state, a through hole extending in a longitudinal direction between a first and a second opening, said through hole having a substantially rectangular cross sectional shape in said longitudinal direction, a width of said cross sectional shape being at least twice a height of said cross sectional shape;

the clip having a second through hole extending generally perpendicularly to the through hole extending in the longitudinal direction, the second through hole extending from the top surface to the bottom surface;

wherein the first part has a rigid, substantially flat surface, which defines a first surface of the through hole adapted to engage the first substantially flat major surface of the elongate member in said closed state, and the second part has a substantially flat surface, which defines a second surface of the through hole opposite of the first surface of the through hole, said rigid, substantially flat surface of the first part and said substantially flat surface of the second part partly defining said through hole;

wherein the clip further comprises a first resilient insert element retained in said second part; and wherein the first resilient insert element has a gripping surface adapted to engage the second substantially flat major surface of the elongate member in said closed state of the clip, said gripping surface partly defining said through hole.

2. The bracelet set or necklace set of claim 1, wherein the first part has a hinge end and an opposed lock end, the hinge being inset from the hinge end, a lock being inset from the opposed lock end, the opposed lock end being beveled where the first part contacts the second part.

3. The bracelet set or necklace set of claim 1, wherein the hinge is located on a plane that is generally centered between the rigid, substantially flat surface of the first part and the substantially flat surface of the second part.

4. The bracelet set or necklace set of claim 1, wherein the hinge is generally centered along the through hole.

5. The bracelet set or necklace set of claim 1, wherein the gripping surface of the first resilient insert element is discontinuous.

6. The bracelet set or necklace set of claim 1, wherein the elongate member is a chain.

7. The bracelet set or necklace set of claim 1, wherein the elongate member is a leather strap or a metal strap.

8. The bracelet set or necklace set of claim 1, wherein the elongate member is suitable for jewelry.

9. A method of assembly of a bracelet or a necklace comprising:

providing an elongate member with a flat cross-sectional shape, and with a first substantially flat major surface and a second substantially flat major surface;

providing a clip in an open state, the clip comprising a first part and a second part connected by a hinge, the clip having a top surface and a bottom surface, the hinge being generally centered between the top surface and the bottom surface, said first and second parts being moveable between the open state and a closed state by rotation about a hinge axis of said hinge, the clip having, in said closed state, a through hole extending in a longitudinal direction between a first and a second opening, said through hole having a substantially rectangular cross sectional shape in said longitudinal direction, a width of said cross sectional shape being at least twice a height of said cross sectional shape, wherein the first part has a rigid, substantially flat surface, which defines a first surface of the through hole, and the second part has a substantially flat surface, which defines a second surface of the through hole opposite of the first surface of the through hole, said rigid, substantially flat surface of the first part and said substantially flat surface of the second part partly defining said through hole, wherein the clip further comprises a first resilient insert element retained in said second part, said first resilient insert element having a gripping surface, said gripping surface partly defining said through hole, wherein a second through hole extends generally perpendicularly to the through hole extending in the longitudinal direction, the second through hole extending from the top surface to the bottom surface;

positioning the clip in an opened state about the elongate member; and bringing the clip to said closed state so that the clip grips the elongate member, whereby the clip and the elongate member form an assembled bracelet or necklace.

10. The method of claim 9, wherein the hinge axis is generally centered along the through hole and about half of the through hole is defined by the first part and about half of the through hole is defined by the second part.

11. The method according to claim 9, wherein, when the clip grips the elongate member, the gripping surface of the first resilient insert element engages the first substantially flat major surface of the elongate member or the second substantially flat major surface of the elongate member.

12. The method of claim 9, wherein the elongate member is a chain.

13. The method of claim 9, wherein the elongate member is a leather strap or a metal strap.

* * * * *